United States Patent [19]

Scheibe

[11] Patent Number: 4,658,824

[45] Date of Patent: Apr. 21, 1987

[54] FUEL-INJECTION DEVICE FOR AN INTERNAL-COMBUSTION ENGINE

[75] Inventor: Wolfgang Scheibe, Remseck, Fed. Rep. of Germany

[73] Assignee: L'Orange GmbH, Fed. Rep. of Germany

[21] Appl. No.: 763,822

[22] Filed: Aug. 7, 1985

[30] Foreign Application Priority Data

Aug. 10, 1984 [DE] Fed. Rep. of Germany ..... 3429471

[51] Int. Cl.[4] ..... F02M 39/00

[52] U.S. Cl. ..... 123/472; 123/446; 239/533.3; 239/533.4

[58] Field of Search ..... 123/357, 446, 472, 299; 239/533.2, 533.3, 533.4, 533.5, 533.6, 533.7, 533.8, 533.9, 533.10, 533.11, 533.12, 585, 562

[56] References Cited

U.S. PATENT DOCUMENTS

| | | | |
|---|---|---|---|
| 2,243,011 | 5/1941 | L'Orange | 239/533.4 |
| 2,398,834 | 4/1946 | Kammer | 123/299 |
| 3,892,362 | 7/1975 | Gayfer | 239/533.9 |
| 4,187,825 | 2/1980 | Loyd | 239/533.3 |
| 4,275,693 | 6/1981 | Leckie | 123/472 |
| 4,471,740 | 9/1984 | Jourde | 123/446 |
| 4,494,700 | 11/1985 | Dolenc | 239/533.3 |
| 4,519,370 | 5/1985 | Iwata | 123/472 |
| 4,526,323 | 7/1985 | Seifert | 239/533.4 |
| 4,546,939 | 10/1985 | Nakajima | 239/533.4 |
| 4,566,634 | 1/1986 | Wiegand | 239/533.12 |

FOREIGN PATENT DOCUMENTS

| | | | |
|---|---|---|---|
| 0056661 | 4/1982 | Japan | 239/533.3 |
| 0079386 | 10/1955 | Netherlands | 239/533.3 |

*Primary Examiner*—Carl Stuart Miller

*Attorney, Agent, or Firm*—Barnes & Thornburg

[57] ABSTRACT

The effective injection cross section of a fuel-injection device is varied by an adjustable shutoff element, whereby the shuttoff element is actuatable by an actuating element as a function of operating parameters of the internal-combustion engine. In the operating position, the shutoff element conducts the fuel directly to a spray hole with large cross section, but in the rest position the fuel is only conducted to the spray hole by way of a nozzle opening with a smaller cross section coaxially adjusted to the spray hole.

7 Claims, 2 Drawing Figures

FUEL-INJECTION DEVICE FOR AN INTERNAL-COMBUSTION ENGINE

BACKGROUND OF THE INVENTION

This invention relates to a fuel-injection device for an internal-combusion engine. The effective nozzle cross section of a fuel-injection device of this type is small during partial-load operation, so that the fuel pressure adjusting itself is great enough to ensure good atomization and an optimal combustion of the fuel. However, during full-load operation the effective injection cross section must be its maximum.

In Swiss Pat. No. 622 588 there is described an injection device of this type in which the fuel delivery to a spray hole in the nozzle body is controllable by a valve needle. A control device having a control edge is displaceably mounted in a bore of the valve needle, which control edge unblocks part of the cross section of the spray hole during partial-load operation of the engine and opens the entire cross section of this spray hole during full-load operation. Thus, in this injection device the fuel is always injected through the same spray hole which is advantageous in some applications. However, it is disadvantageous that the shape of the jet does not solely depend on the shape and the dimensions of the spray hole. Further, during partial-load operation the fuel under high pressure is deflected by the control edge on the control device so that the vorticity will be effected, the result of which is a lower speed of the fuel delivery as it leaves the spray hole. This results in a detoriation of the jet shape and unfavorable combustion action.

This disadvantage is overcomed in an embodiment according to the British Pat. No. 1 593 112. In this embodiment, two spray holes are incorporated in the nozzle body, whereby the fuel delivery to the two spray holes is controllable by a valve needle. A shutoff element is axially displaceably guided in a bore of the valve needle, which shutoff element shuts off one of the two spray holes in the rest position. Thus, during full-load operation in this embodiment, the fuel is injected into the combustion chamber through both spray holes. However, during partial-load operation one spray hole is shut off and the fuel is only injected through the other spray hole. In the embodiment, the jet shape solely depends on the shape and on the dimensions of the spray holes. Thus, this embodiment has the advantage that the high fuel pressure existing on the inlet opening of the spray hole is turned into a high fuel speed alongside the spray hole as far as the outlet opening which is essential for an optimal combustion. However, it is disadvantageous in some applications that in partial-load operations and in full-load operation that the number of the injection jets and their position are different. Furthermore, in this embodiment there is a danger of coking at the spray hole controlled by the control device if the spray hole is shut off for a longer time.

A fuel-injection device is known from German specification OS No. 26 56 276, in which the disadvantage last mentioned has been avoided; wherein during partial-load operation the fuel is conducted through nozzle openings which effect the necessary reduction of the cross section, whereby these nozzle openings are coaxially adjusted to the spray holes in the nozzle body. Thus, in this embodiment the fuel always emerges through the same spray holes both at partial-load operation and at full-load operation. Therefore, there is no danger of coking at these spray holes. However, the complexity of this embodiment is disadvantageous because one valve is required for partial-load operation and another for full-load operation, whereby one fuel channel each is conducted to these valves and the fuel supplied by the pump is selectively delivered to one or the other fuel channel by additional means.

It is a disadvantage of all of these known devices in that the change over from partial-load operation to full-load operation is at least indirectly dependent on the pressure of the fuel supplied. This makes it difficult to determine the switching point at which the nozzle cross section is to be enlarged. This is particularly disadvantageous in internal-combustion engines with several injection nozzles, because due to unavoidable tolerances a uniform and simultaneous change over from the smaller to the larger nozzle cross section cannot be ensured for all injection nozzles. It is furthermore disadvantageous that, as illustrated in the Swiss Pat. No. 622 588, that the control device is also adjusted to each injection and thus it is subject to high loads and increased wear.

The present invention, therefore, addresses the problem of improving a fuel-injection device of the type described in which an optimal combustion of the fuel is achieved including multi-cylinder engine applications, without increased complexity.

The invention is thereby based on the problem of realizing the principle according to the German specifications OS No. 26 56 276 with a single fuel supply channel, that is the operating position of the control device the fuel is directly conducted to the spray hole, but in the rest position of the control device the fuel is conducted to the spray hole only be way of the nozzle opening with the reduced cross section coaxially adjusted thereto. Furthermore, the present invention is based on the finding that a uniform switching behavior of the shutoff elements of several injection nozzles can be achieved, if the adjusting action of these shutoff elements is released by an active actuating element independently of the position of the valve needle and independently of the pressure of the fuel supplied. Because the change over of this control device is independent of the fuel pressure, this control device can be changed over into the respective position before an injection begins, so that in full-load operation the larger nozzle cross section is already effective at the beginning of the injection. It is furthermore advantageous that according to the present invention the position of this control devices remains unchanged for several injections, while in the prior art this control device is adjusted with each injection with a pressure-dependent control.

SUMMARY OF THE INVENTION

The present invention is realized in such a way that a change-over valve is integrated into the nozzle body, which change-over valve is controlled by the control device and in the operating position closes a connection between the spray holes and the fuel supply channel. However, in the rest position it effects a connection between the fuel supply channel and the nozzle openings. This embodiment requires an increased complexity and is accommodated with some difficulty in the limited space available in the nozzle body. Therefore, in a preferred embodiment, the control device controls a shutoff element by way of which the direct fuel delivery to the spray hole can be shut off. The fuel supply to the spray holes by way of the nozzle openings is always ensured independently of the position of the control device by way of a fuel-channel bypassing this shutoff element.

The shutoff element could be formed as an additional structural unit, however, in this preferred embodiment this shutoff element is combined in a structural unit with the control device. Other embodiments are conceivable in which the nozzle openings coaxially adjusted to the spray holes are fixed in the nozzle body with the smaller cross section, however, in the preferred embodiment these nozzle openings are integrated in the control device and moved with it.

BRIEF DESCRIPTION OF THE DRAWING

The invention and its advantages are described below in detail by way of the embodiment shown in the accompanying drawing where FIG. 1 illustrates the control device in its rest position and FIG. 2 illustrates the device in its operating position.

DETAILED DESCRIPTION

Figure 1:
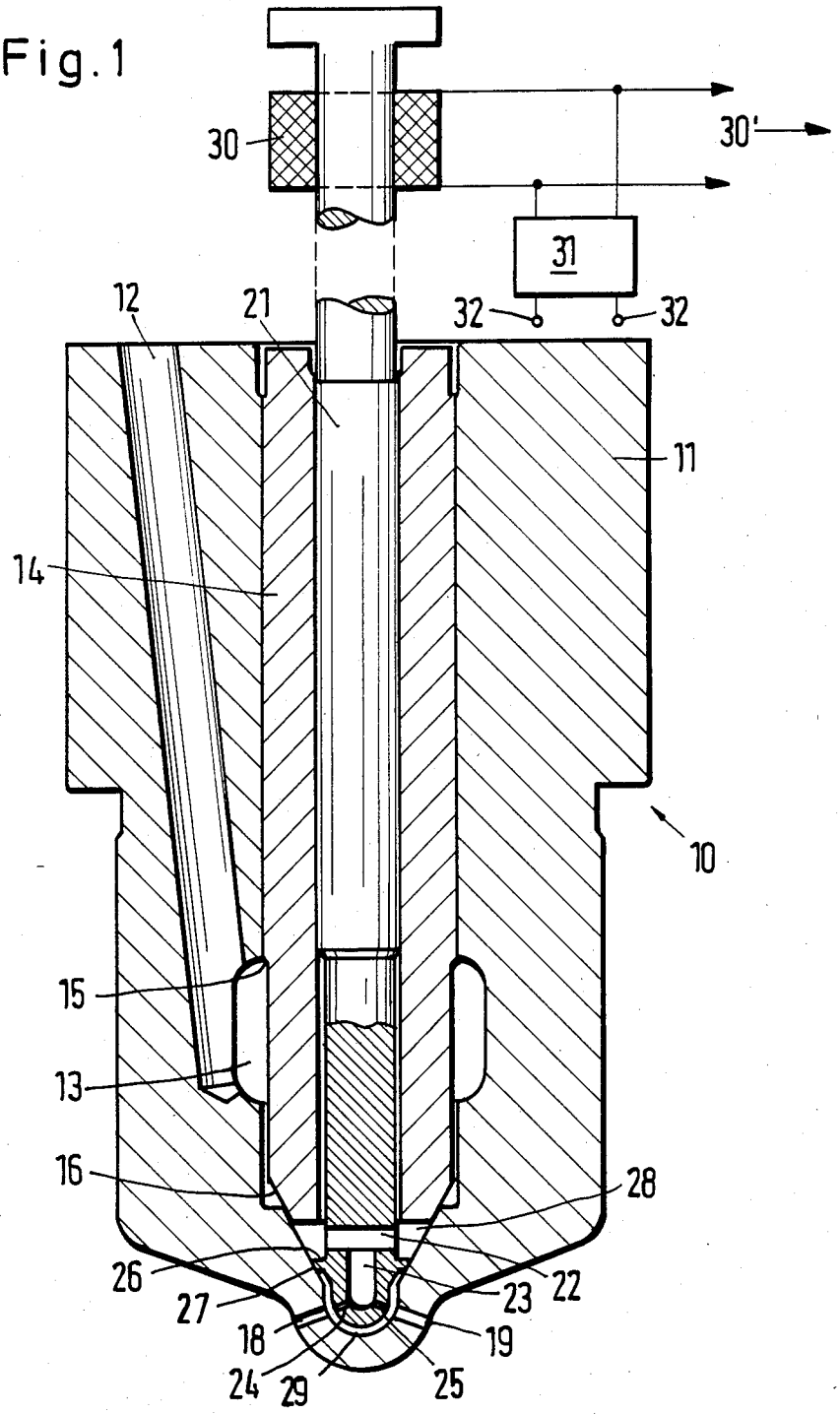
FIGS. 1 and 2 show a section through a fuel-injection nozzle body in a schematic representation.

In FIG. 1, the injection nozzle is shown generally at 10 including a nozzle body 11 housing a fuel delivery channel 12 incorporated therein which opens into a fuel accumulating chamber 13. In the nozzle body 11, a valve needle 14 is mounted in an axially displaceable manner. This valve needle 14 includes an exposed annular area 15 in the vicinity of the fuel accumulating chamber 13 and a valve cone 16 on the front side, which valve cone cooperates with a valve seat 17 in the nozzle body 11. The nozzle body 11 has several spray holes 18 and 19, which are set off in the circumferential direction. The valve needle 14 is lifted by the pressure of the fuel in the inlet bore 12 in a known manner, so that the fuel can flow past the valve seat to the spray holes 18 and 19 and from there into the combustion chamber of the internal-combustion engine.

In a bore 20 of the valve needle 14 there is mounted a control device 21 axially displaceably. The portion of this control device 21 projecting from bore 20 has an aperture 22 transverse to the direction of adjustment. A central pocket hole 23 projects from aperture 22 and into which open two nozzle openings 24 and 25. As illustrated in the drawings, these nozzle openings have a smaller cross section than the spray holes 18 and 19. In the rest position of the control device according to FIG. 1, these nozzles openings 24 and 25 are coaxially adjusted relative to the spray holes 18 and 19. Furthermore, a circumferential flange 26 is integrally formed on the control device which flange cooperates with a corresponding sealing surface 27 on the nozzle body 11. This flange 26 and the sealing surface 27 form together a shutoff element which, when the valve needle 14 is open, shuts off a direct fuel delivery from the annular space 28 below the valve needle into the annular space 29 and thus to the spray holes 18 and 19. The flange 26 thereby acts as a closing body of this shutoff element. Because circumferential flange 26 is arranged in an area between the aperture 22 and the nozzle openings 24, 25 a fuel channel is formed by way of the aperture 22 and the pocket hole 23 which bypasses the shutoff element. These parts are arranged directly integrally on the control device 21, so that the space requirement is not increased and the construction and mounting are very simple.

Figure 2:
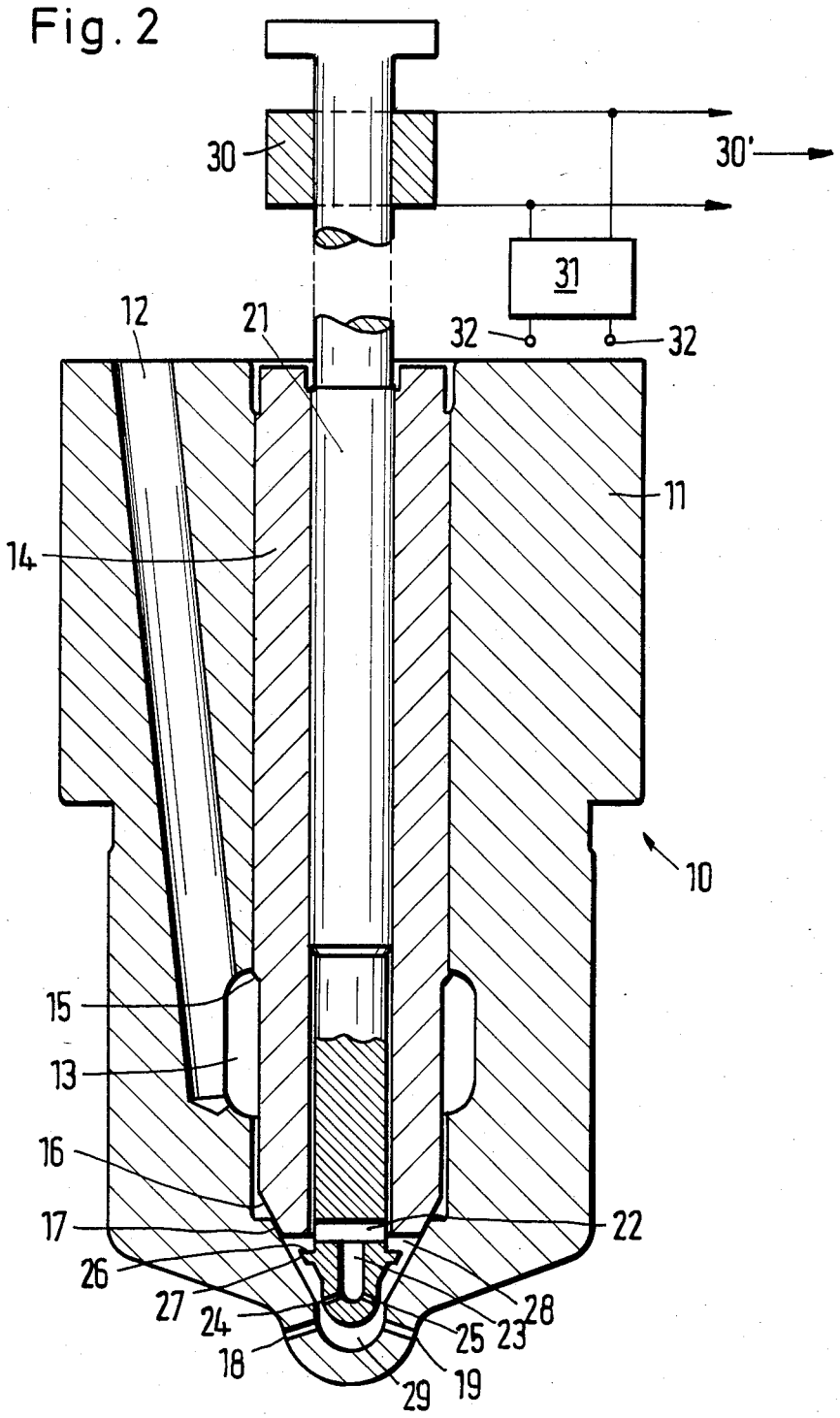

In FIGS. 1 and 2, an actuating element 30 in the shape of an electromagnet has been indicated by way of which control device 21 may be changed over between the rest position and the operating position. This adjusting element 30 is controlled by a circuit 31 to whose input 32 signals are conducted which depend on operating parameters of the internal-combustion engine—for example, the rotational speed. Furthermore, as indicated in the Figures of the drawing, actuating elements 30' pertaining to other injection nozzles are controlled by this circuit 31. In this manner, it is ensured that in a multi-cylinder engine all control devices of the various injection nozzles are changed over simultaneously and occupy the same switching position at any time.

The function of this injection device is described in detail below: A pump (now shown) supplies fuel into the fuel delivery channel 12. As soon as a particular pressure is reached the valve needle 14 is displaced against the force of a valve closing spring (not shown) so that the fuel can flow past the valve seat 17 into the annular space 28 and in the rest position of the control device 21 by way of the aperture 22, the pocket hole 23, the nozzle openings 24, 25, the annular space 29 to the spray holes 18, 19 and from there into the combustion chamber. Thereby the effective injection cross section is small because, in the rest position of the control device 21, the direct fuel delivery to the spray holes 18, 19 is shut off and the fuel can only emerge by way of the nozzle openings 24, 25. In this connection, it is important that the jet formation in this partial-load operation is solely determined by the shape and the diameter of these nozzle openings 24 and 25 which are exactly gauged with regard to the flow-through value. The spray holes located in front of the nozzle openings do not affect the jet formation or only to a negligible extent.

If, however, the control device occupies the operating position shown in FIG. 2, the fuel, with open valve needle, can flow from the annular space 28 directly to the annular space 29 and from there through the larger cross-section spray holes 18 and 19 into the combustion chamber. It is pointed out that in this position of control device 21, there also exists a connection by way of aperture 22, the pocket hole 23, and the nozzle openings 24 and 25. However, at most, only a small quantity of fuel will flow by way of this fuel channel. This is because in the operating position of the control device 21 a pressure compensation is created between annular space 29 and annular space 28. If a full-pressure compensation could not be achieved due to a throttle effect in the area between the annular flange 26 and the sealing surface 27 on the nozzle body 11, and if, in that case, two liquid streams would meet at the inlet opening of the spray holes 18, 19 and result in vorticities, the aperture 22 could dip by an increase of the lift of the control device 21 completely into the valve needle 14, so that this fuel channel to the nozzle openings 24, 25 would be shut off in the operating position of the control device 21.

An example is shown in the drawing in which this control device 21 is adjustable in the axial direction of the valve needle 14. Of course, other embodiments can be provided in which this control device is turned about its longitudinal axis. An electromagnet has been indicated as an active adjusting element. However, hydraulic or pneumatic adjusting elements could also be used for the adjustment of control device 21. In this connection it is, however, essential that this control device is changed over and held in the respective rest position or operating position by way of these adjusting elements, independently of the injection pressure of the fuel supplied.

The present invention provides a fuel-injection device in which the effective injection cross section is variable by a control device. The design of injection nozzle is very simply built and the measures of combining functionally important parts with the shutoff element to form a structural unit are a significant contribution to the art.

What is claimed is:

1. A fuel-injection device for an internal-combustion engine comprising at least one injection nozzle, whose nozzle body has at least one spray hole, wherein the fuel delivery to said spray hole is controllable by way of a valve needle displaceable in the nozzle body and wherein the effective injection cross section is variable by a control device whose position depends on operating parameters of the internal-combustion engine, wherein the fuel is directly conducted to the spray hole (18, 19), in the operating position of the control device (21), wherein the fuel is conducted to the spray hole (18, 19) only by way of a nozzle opening (24, 25) substantially coaxially aligned relative to the spray hole (18, 19), in the rest position of the control device (21), wherein the cross section of said nozzle opening is smaller than the cross section of said spray hole (18, 19), and wherein the control device (21) is changed over between the rest position and the operating position by an actuating element (30) independently of the position of the valve needle (14).

2. A fuel-injection device according to claim 1, wherein the control device (21) controls a shutoff element (26, 27) which directs fuel delivery to the spray hole (18, 19) and which can be stopped, and wherein a fuel channel (22, 23) bypasses said shutoff element (26, 27) and conducts the fuel to the nozzle opening (24, 25).

3. A fuel-injection device according to claim 2, wherein said fuel channel (22, 23) is shut off in the opening position of the control device (21).

4. A fuel-injection device according to claim 2, wherein the control device (21) is adjustably guided in a bore (20) of the valve needle (14), wherein the closing body (26) of the shutoff element is arranged on the portion of the control device (21) projecting from the bore (20) which closing body cooperates with a corresponding sealing surface (27) on the nozzle body (11), and wherein the fuel channel (22, 23) bypassing the shutoff element (26, 27) and the nozzle opening (24, 25) are incorporated in the control device (21).

5. A fuel-injection device according to claim 4 wherein the control device (21) is adjustable in the axial direction of the valve needle (14), wherein, when the shutoff element (26, 27) is closed in the rest position of the control device (21), the nozzle opening (24, 25) is coaxially adjusted relative to the spray hole (18, 19).

6. A fuel-injection device according to claim 5, wherein the control device (21) has an aperture (22) on its portion projecting from the bore (20) of the valve needle (14) transversely to the direction of adjustment and includes a coaxial pocket hole bore (23) beginning from said aperture (22) into which the nozzle opening opens (24, 25) and wherein the control device (21) has a circumferential flange (26) in an area between this aperture (22) and the nozzle opening (24, 25) whereby the aperture (22) and the pocket hole bore (23) form the fuel channel to the nozzle opening (24, 25) and the flange (26) as a closing body of the shutoff element which cooperates with a sealing surface (27) on the nozzle body.

7. A fuel-injection device according to claim 1, wherein the actuating element (30) operates mechanically, hydraulically, pneumatically or electro-mechanically and wherein said actuating element is controlled by way of switching signals as a function of operating parameters of the internal-combustion engine.

* * * * *